US006543889B2

(12) United States Patent
Murcia et al.

(10) Patent No.: US 6,543,889 B2
(45) Date of Patent: Apr. 8, 2003

(54) PRINTING SYSTEM FOR APPLICATION OF DIFFERENT INK TYPES TO CREATE A SECURITY DOCUMENT

(75) Inventors: Antoni Murcia, San Diego, CA (US); Ted T. Lee, San Diego, CA (US); Juan Carlos Vives, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/777,499

(22) Filed: Feb. 5, 2001

(65) Prior Publication Data

US 2002/0105569 A1 Aug. 8, 2002

(51) Int. Cl.[7] ..... B41J 2/01
(52) U.S. Cl. ..... 347/101
(58) Field of Search ..... 347/14, 15, 43, 347/98, 101, 105, 106; 427/154, 155, 156; 428/198; 283/72, 74

(56) References Cited

U.S. PATENT DOCUMENTS 4,021,252 A * 5/1977 Banczak et al. ..... 106/31.42
4,726,608 A 2/1988 Walton
5,149,138 A 9/1992 Zemsky
5,523,167 A 6/1996 Hunt
5,591,553 A 1/1997 Snelling
5,661,509 A * 8/1997 Dochovna ..... 347/14
5,944,881 A 8/1999 Mehta
5,957,458 A 9/1999 Haas
5,992,892 A * 11/1999 Schaefer et al. ..... 283/901
6,142,533 A 11/2000 Borowski
6,244,688 B1 * 6/2001 Hickman ..... 347/43

* cited by examiner

*Primary Examiner*—John Barlow
*Assistant Examiner*—Michael S. Brooke

(57) ABSTRACT

A security document includes a secure message which is obscured by a frangible layer of opaque material. The frangible layer of opaque material may be removed using light abrasion. The security document is printed on an especially prepared print media, which may include a substrate of paper, light card stock, or plastic film, for example. The printing method may be carried out using a common inkjet printer, or a printer of another type may be used to print such a security document. Methods of performing the printing operation are explained, and especially configured printing apparatus for practicing the method is also disclosed. A covert printed security document, and method of making such a document is presented.

13 Claims, 5 Drawing Sheets

FIG. 5.a.
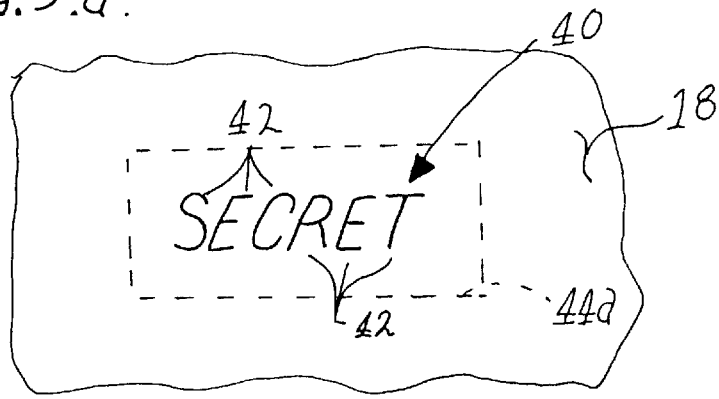
FIG. 5. b.
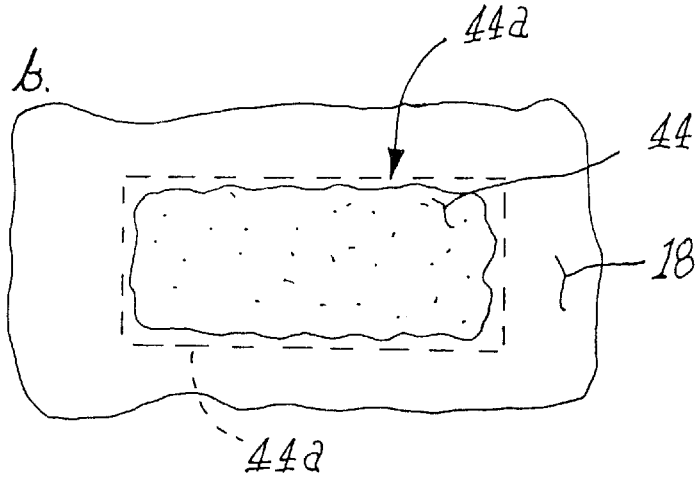
FIG. 5.C.
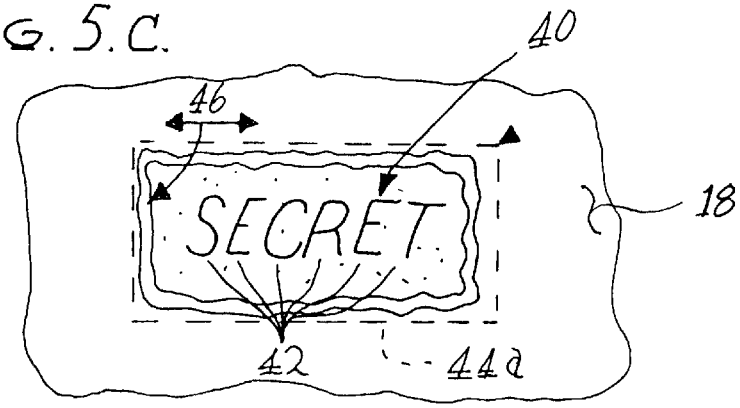

PRINTING SYSTEM FOR APPLICATION OF DIFFERENT INK TYPES TO CREATE A SECURITY DOCUMENT

BACKGROUND OF THE INVENTION

1. Field of the Invention

This invention is in the field of security documents. Particularly, this invention relates to security documents that are made by printing on a print media, such as on paper or card stock. Generally, this invention also relates to thermal inkjet printing used to create such security documents, although the invention is not so limited. More particularly, this invention relates to security documents, such as lottery tickets, to secure identification documents, and to secure communication documents, for example. A printing method for producing such security documents may employ thermal inkjet printing. The invention relates also to a print media for use in a printer, which may be of thermal inkjet type. Alternatively, a printing method for such a security document may employ a form of printing other than thermal inkjet printing. In both cases, printers of the types commonly available with home and office computer systems are employed. The invention also relates to a thermal inkjet printing apparatus which is capable of practicing the method and of producing security documents embodying this invention.

2. Related Technology

Conventional security documents, such as lottery tickets, for example, are commonly produced using a security printing method requiring several printers and several printing steps. For example, one form of security document involves use of a print media, such as a paper or light card stock. On this paper or light card stock printing media may be first conventionally printed a first contextual printing "field" of monochrome or multicolor printing. This first field may be printed using a pigment or die penetrant type of ink. However, some conventional security documents will omit this first printing field of contextual information. That is, this first printing "field" usually contains contextual information, such as characters and images, for identifying the nature of the security document. This first printing "field" may include information concerning the fact that the document is a lottery ticket, or a transmittal document for a bank "PIN" number, for example. In such a use, the first printing field would perhaps contain information identifying the State issuing the lottery ticket, the name and logo of the game being played, perhaps information about how the game is played, information about a valid way to reveal the lottery numbers (such as by the user scratching only a portion of a top opaque "field" off the ticket), and other such information. Alternatively, if the document is a bank "PIN" number transmittal document, then the first printing field would perhaps contain the bank's name, and the information about how the recipient is to reveal the bank "PIN" number. This first printing field will usually designate and indicate an area (i.e., a "secure area") within which the lottery numbers, bank "PIN" number, etc., is to be found. Security documents of this conventional type are easily recognized as such.

The recipient of such a bank "PIN" number transmittal document, for example, would be assured that the document is secure, because the "PIN" number is obscured by a top "field" of opaque coating. Only after the recipient removes this obscurant coating is the PIN number visible. Alternatively, some security documents would omit this first printing field either because it is not necessary, or because it may in fact be undesirable. For example, it may be desired to keep confidential the nature of the document, and its source of origin. Nevertheless, conventional security documents with a "scratch off" area are easily recognized.

Although security documents may be of virtually any size and shape, generally, such conventional security documents are individually small, and are printed many at a time in large sheets on a printing press which deposits the characters and graphic images for the first printing field on the entire sheet at once. The sheets may be pre-scored or pre-perforated to facilitate their separation later into a plurality of relatively small lottery tickets, or into card-sized security documents, for example. The printing media may be in the form of an elongate "tape" or "ribbon" of plural pre-scored or perforated ticket portions, or of plural security coupons or cards, that are at this stage secured together. In this latter case, the print media is generally handled in the form of a roll rather than as sheets. In the event that the first printing field involves plural colors, then the first multi-color printing press or a series of monochrome presses (i.e., one for each of the various colors) much achieve proper registration and congruence of the various characters and images that make up the first printing field. This problem of achieving acceptable congruence or registration within a first and subsequent printing fields can result in considerable printing labor and scrap from trial-and-error set up attempts.

Conventionally, the sheets or ribbons or rolls of print media with the first printing field applied then have a coating applied, which is generally transparent to allow the first printing field to be viewed through the coating. This coating may have plural layers, with a lower layer (i.e., closer to the substrate) that substantially prevents penetration of subsequent pigment printing to the print media. On this substantially impenetrable layer, may be applied an upper layer (i.e., usually a top-most layer furthest away from the substrate) to which subsequent pigment printing will adhere with a satisfactory degree of tenacity. This coating step may require one or more coating machines through which the sheets, ribbons, or rolls of lottery tickets or security documents are run.

Next, the individual lottery numbers or bank "PIN" numbers are printed on the individual tickets, security cards, or security coupons. This printing step is carried out with a printing press that call individually access each ticket, card, or coupon. That is, the printing press must be able to print different information, numbers, or characters in the secure area of each of the several tickets, cards, or coupons of a sheet. In the case of a print media that is an elongate strip fed from a roll, then the printing operation must be able to index the applied information in the secure field according to a determined sequence of under control of an information generator or source. For example, a computer system may be supplying PIN numbers to be printed in particular secure fields of identified security cards for a bank. Again, a problem arises of achieving satisfactory registration or congruence of the printing performed at this stage with the previous first printing field. That is, the secure information must be placed within the designated secure area (i.e., as was explained above) where the user of the document expects to find the confidential information or the winning lottery numbers.

Finally, an opaque, frangible printing layer is applied over at least the designated secure area of the security document in order to obscure the lottery numbers, PIN number, or other confidential information. Again, this final printing step may require more than one layer and more than one printing press and operation for its completion. That is, the opaque layer may include a layer of loosely bonded particulate material, such as granular latex in a bonding carrier. This first layer is applied over the secure area, and is then itself perhaps coated with one or more subsequent layers to better secure the opaque layer and to further promote security of the confidential information by making the opaque later somewhat difficult to remove. This removal difficulty for the opaque layer, for example, insures that removal of the opaque layer causes some abrasion of the underlying coatings and substrate, so that the lottery numbers cannot be changed without evidence of this fact. Also, the overlying layers will resist "washing" of the document, so that an attempt to wash off the secure lottery numbers, for example, and to replace these with "winning" numbers, would necessarily damage the underlying layers and/or substrate. Such factors are used in combination to discourage and to reveal fraud in lottery and other games.

U.S. Pat. No. 4,925,705 (the '705 patent), issued May 15, 1990, to George R. Hill. This '705 patent appears to teach a method of printing layers having substantially exact registration. Although this '705 patent is addressed to the printing problems arising in the electronics industry (i.e., in which circuit elements and traces are made by printing), the patent mentions the application of the invention to the security document printing industry.

However, it is apparent in view of the above that the conventional technology for producing security documents with a "scratch off" or removable portion, has many detriments. First of all, many printing steps are required, and expensive printing equipment is necessary to carry out these printing steps. Further, the nature of the conventional "scratch off" security documents is apparent, thus compromising their security. Further, the production of satisfactory security documents has not heretofore been possible for the home office, small business or other user who wishes to produce the occasional security document without the need to make access to a large and often expensive commercial printing concern.

To the present time, it is believed that a print media, printing method, and printing apparatus are not available which would allow security documents to be produced on home and office printers of the type generally available with small computer systems. That is, prior to this invention, there was no way to produce a security document utilizing a commonly available inkjet printer.

SUMMARY OF INVENTION

In view of the deficiencies of the related technology, an object for this invention is to reduce or overcome one or more of these deficiencies.

Accordingly, the present invention provides an inkjet printer, the inkjet printer being especially configured for printing security documents, the inkjet printer comprising: a base carrying a printer housing, the printer housing defining a printing path, a print media feed mechanism controllably moving print media through the printer housing along the printing path, a traverse mechanism having a carriage carrying a pair of inkjet print cartridges for movement together generally transversely to the printing path, each of the pair of inkjet print cartridges including: a cartridge body defining a printing fluid chamber, and a printing fluid delivery assembly; a print head providing a plurality of fine dimension print orifices, the print head receiving printing fluid from the printing fluid chamber via the printing fluid delivery assembly and controllably ejecting this printing fluid from the fine dimension printing orifices onto the print media, a first of the inkjet print cartridges carrying as the printing fluid and discharging onto the print media a dye penetrant type ink, which dye penetrant type ink when discharged onto the print media penetrates into the print media to form characters or images of a secure permanent message; and a second of the inkjet print cartridges carrying as the printing fluid and discharging onto the print media an opaque pigment type ink, which opaque pigment type ink when discharged onto the print media does not substantially penetrate into the print media, but forms an opaque over coating obscuring the secure permanent message.

According to another aspect, this invention provides an inkjet printer, print media, and inkjet print cartridge combination which are especially combined to enable printing security documents, which security documents include the print media, a secure permanent message imbedded into the print media, and an apparent but not permanent message or printed area of opaque ink over coating and hiding the secure permanent message, the printer, media, and inkjet cartridge combination comprising: a) the printer including: a base carrying a printer housing defining a printing path, a print media feed mechanism controllably moving print media through the printer housing along the printing path, a traverse mechanism having a carriage for carrying at least a pair of inkjet print cartridges for movement together generally transversely to the printing path, b) a pair of inkjet print cartridges, each of the pair of inkjet print cartridge including: a cartridge body defining a printing fluid chamber, a printing fluid delivery assembly; a print head providing a plurality of fine dimension print orifices, the print head receiving printing fluid from the printing fluid chamber via the printing fluid delivery assembly and controllably ejecting this printing fluid onto the printing media; c) a first of the pair of inkjet print cartridges carrying as the printing fluid and discharging onto the print media a dye penetrant type ink, which dye penetrant type ink penetrates into the print media to form characters or images of the secure permanent message; and d) a second of the pair of inkjet print cartridges carrying as the printing fluid and discharging onto the print media an opaque pigment type ink, which opaque pigment type ink does not substantially penetrate into the print media, but forms an opaque over coating obscuring the secure message; e) the print media comprising: a substrate; a coating layer of material disposed upon the substrate, the coating layer of material having an upper surface, and being penetrable by dye penetrant type ink to allow the dye penetrant type ink to enter into and through the coating layer to reach the substrate, and the coating later of material not allowing pigment type ink to penetrate the upper surface; whereby pigment type ink printed upon the upper surface is tenuous thereon, and may be removed by use of mild abrasion so as to reveal the secure message printed with dye penetrant ink.

Still another aspect of the present invention provides a method of especially configuring an inkjet printer for printing, security documents, the method comprising steps of:

a) providing the inkjet printer with: a base carrying a printer housing, the printer housing defining a printing path, a print media feed mechanism controllably moving print media through the printer housing along the printing path, a traverse mechanism having a carriage carrying a pair of inkjet print cartridges for movement together generally transversely to the printing path;

b) providing each of the pair of inkjet print cartridges with: a cartridge body defining a printing fluid chamber, and a printing fluid delivery assembly; a printed providing a plurality of fine dimension print orifices, the print head receiving printing fluid from the printing fluid chamber via the printing fluid delivery assembly and controllably ejecting this printing fluid from the fine dimension printing orifices onto the print media;

c) providing a first of the inkjet print cartridges as the printing fluid with a dye penetrant type ink, and when the dye penetrant type ink is discharged onto the print media penetrating the dye penetrant type ink into the print media to form characters or images of a secure permanent message; and d) providing a second of the inkjet print cartridges as the printing fluid with an opaque pigment type ink, and when the opaque pigment type ink is discharged onto the print media not substantially allowing the pigment type ink to penetrate into the print media, but forming an opaque over coating obscuring the secure permanent message, and allowing the opaque over coating of pigment type ink to bond with the print media only with a selected degree of tenacity; whereby the opaque pigment type ink may be removed from the print media using mild abrasion to reveal the secure message.

Other objects, features, and advantages of the present invention will be apparent to those skilled in the pertinent arts from a consideration of the following detailed description of a single preferred exemplary embodiment of the invention, when taken in conjunction with the appended drawing figures, which will first be described briefly.

BRIEF DESCRIPTION OF THE DRAWING FIGURES

FIG. 1 is a diagrammatic side elevation view of an exemplary inkjet printer which uses a pair of exemplary inkjet print cartridges to produce a security document according to the present invention;

FIG. 2 provides a diagrammatic view of the pair of inkjet print cartridges carried by a carriage of the printer seen in FIG. 1, and shows the pair of cartridges during printing of a security document;

Figure 1:
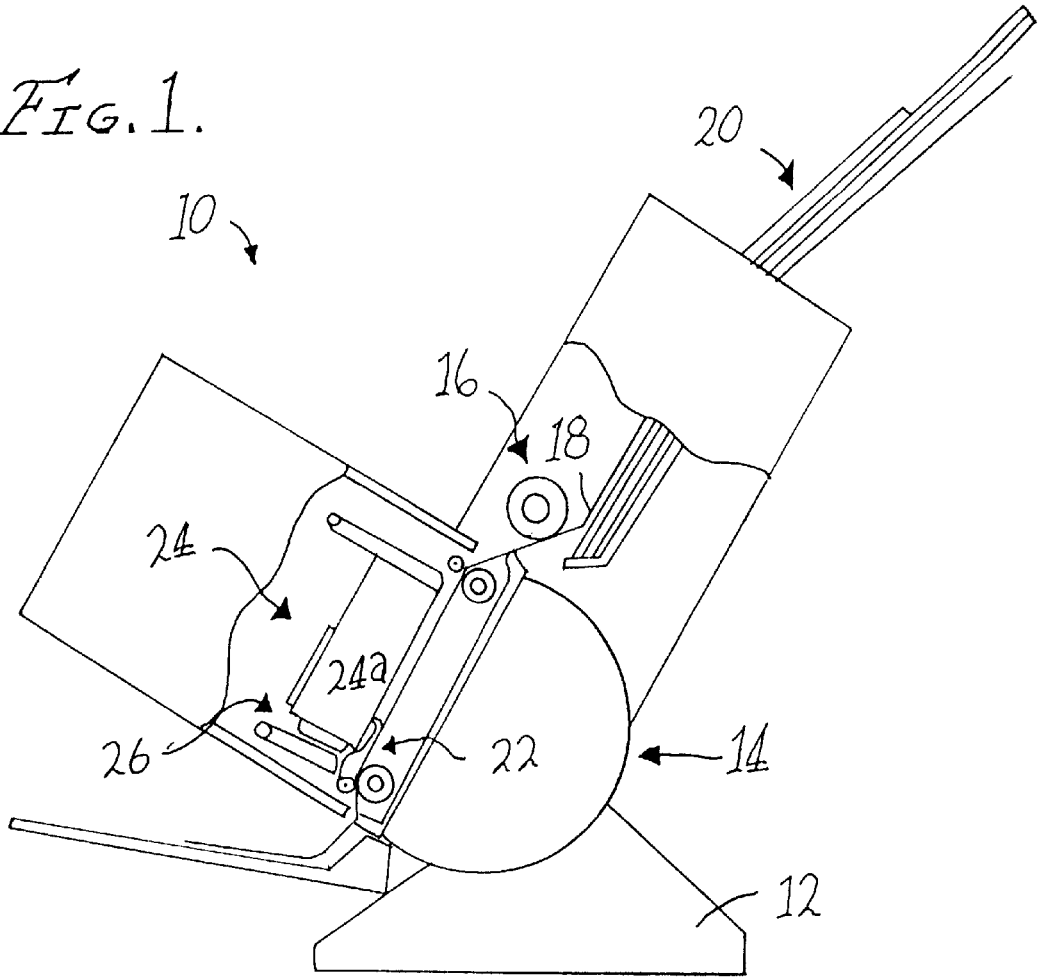
Figure 3:
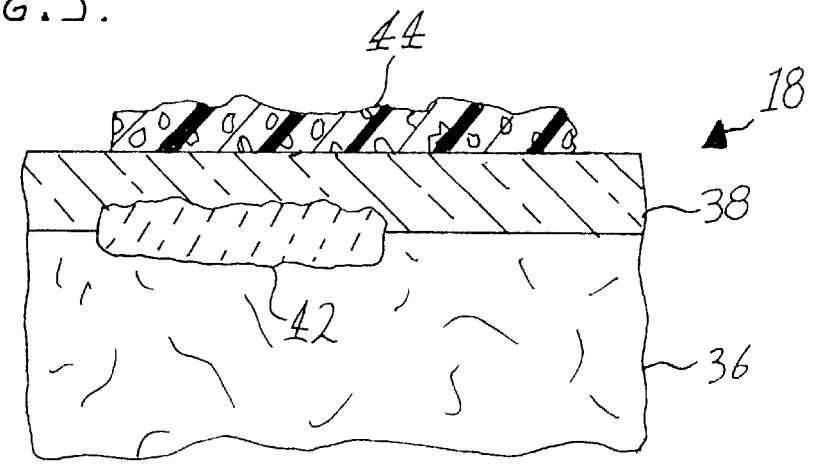
FIG. 3 is a diagrammatic view in cross section of a first embodiment of a print media and printed security document embodying the present invention.
Figure 4:
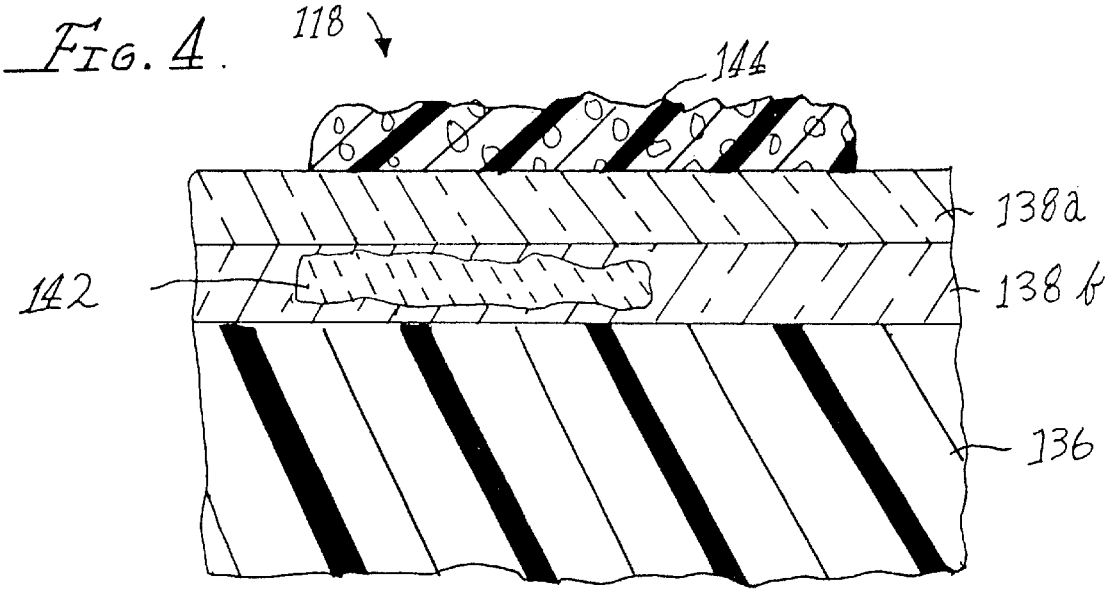
FIG. 4 is a diagrammatic view in cross section similar to FIG. 3, but showing an alternative second embodiment of a print media and printed security document embodying this invention.
Figure 8:
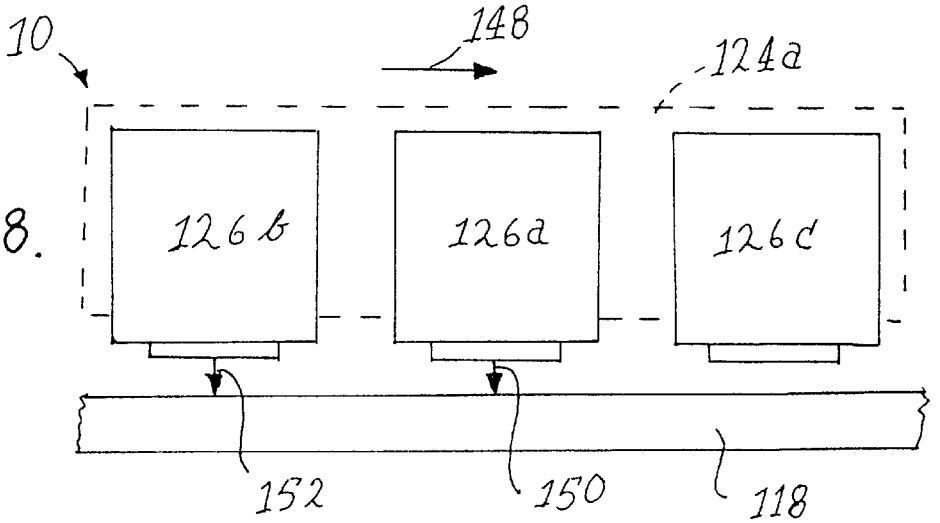
Figure 9A:
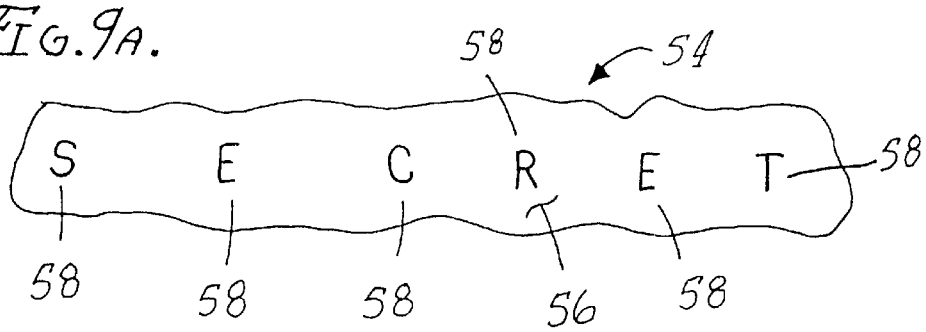
Figure 9B:
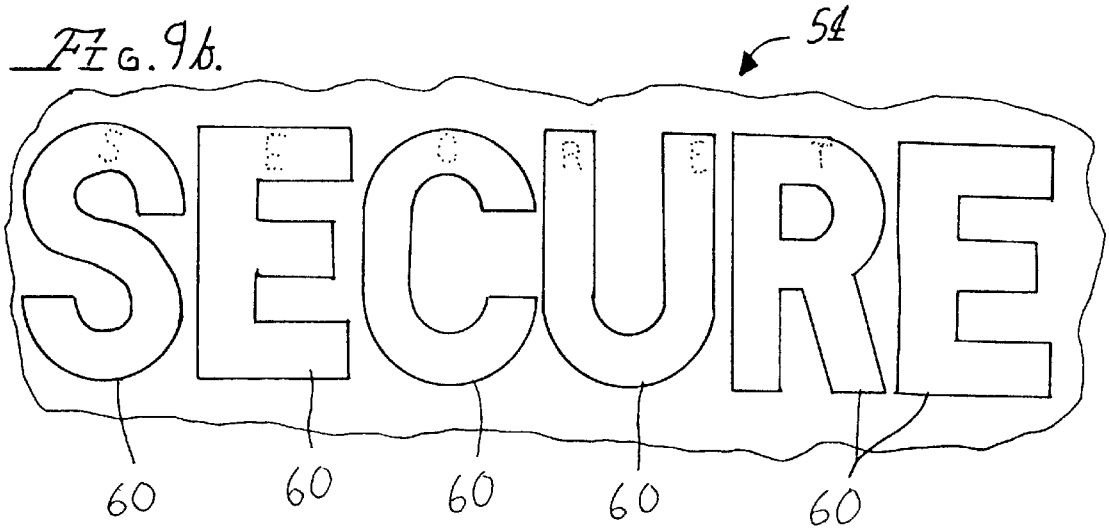

FIGS. 5*a,* 5*b,* and 5*c* provide successive plan views of a print media and printed security document being produced on this print media, with the document being shown in successive stages of the method of printing the document, and with the message revealed;

FIGS. 6*a* through 6*e* provide successive views in cross section of a print media of the type illustrated in FIG. 3, with successive stages in the method of printing a security document on this print media being depicted;

FIGS. 7*a* through 7*e* provide successive views in cross section of a print media of the type illustrated in FIG. 4, with successive stages in the method of printing a security document on this print media being depicted;

FIG. 8 provides a diagrammatic view of a trio of inkjet print cartridges carried by a carriage of an inkjet printer similar to the one seen in FIG. 1, and shows the trio of cartridges during printing of a security document; and FIGS. 9*a* and 9*b* provide respective plan views during the process of printing a security document according to the present invention.

DETAILED DESCRIPTION OF THE PREFERRED EXEMPLARY EMBODIMENTS OF THE INVENTION

FIG. 1 shows all exemplary inkjet printer 10. This printer 10 includes a base 12 carrying a housing 14. Within the housing 14 is a feed mechanism 16 for controllably moving a print medium (i.e., paper, light card stock, or plastic film, for example) through the printer 10. The feed mechanism 16 controllably moves a sheet of the print media 18 from a paper magazine 20 along a print path 22 within the printer 10. The printer 10 includes a traverse mechanism 24 with a carriage 24*a* carrying one or more inkjet print cartridges, which cartridges are generally referenced in FIG. 1 with the numeral 26. The traverse mechanism 24 controllably moves the inkjet print cartridge(s) 26 perpendicularly to the direction of movement of the paper 18 (i.e., the media 18 is moved in the plane of FIG. 1, and the cartridge(s) 26 are moved perpendicularly, to the plane of this Figure). The printer 10 uses the inkjet printing cartridge(s) 26 to controllably place small droplets of printing fluid (i.e., ink, for example) from the inkjet printing cartridge(s) 26 on the paper 18. The small ink droplets form "pixels" of printed characters or images. By moving the inkjet printing cartridge(s) 26 repeatedly back and forth (i.e., scanning the cartridges) across the paper 18 as this paper is advanced by the feed mechanism 16, characters or images may be controllably formed by ejection of the small droplets of ink from the cartridge(s) 26. These small droplets of ink are ejected in the form of ink jets impinging on the paper 18 in controlled locations to form characters and images, as will be well known to those ordinarily skilled in the pertinent arts.

Figure 2:
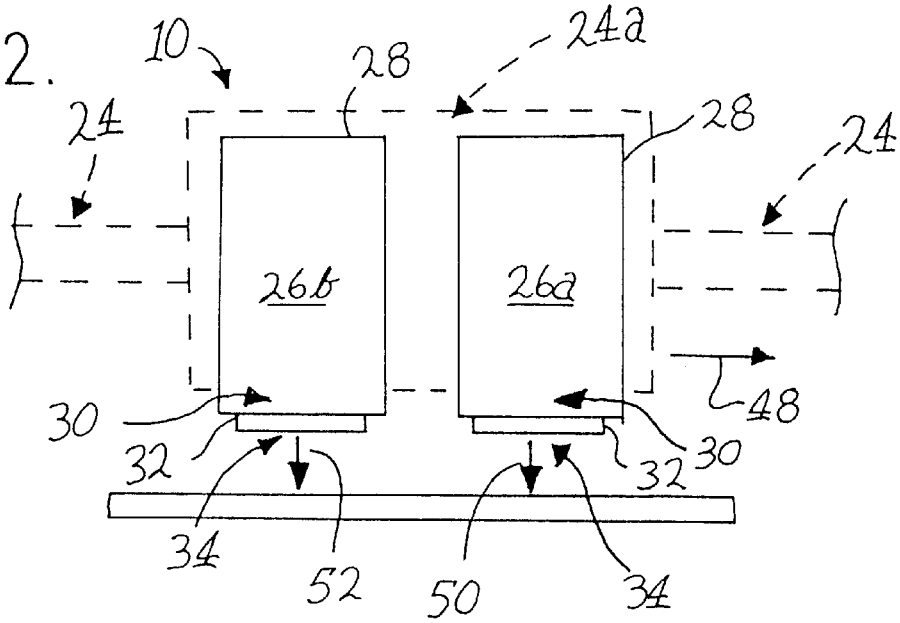

FIG. 2 illustrates the exemplary inkjet printing cartridge (s) 26 in an elevation view looking generally along the plane of the print media at the location where this print media passes under the cartridge(s) 26. In this view, the paper 18 would move perpendicular to the plane of the Figure, and it is seen that the printer 10 is employing two print cartridges 26*a* and 26*b*. Such an arrangement of two print cartridges in a dual carriage of an inkjet printer is conventional. That is, some conventional inkjet printers use one cartridge for black ink, and a second color cartridge having respective ink reservoirs and print heads for each of cyan, magenta, and yellow inks. This arrangement allows the printer to perform both black-and-white and color printing without having to exchange black ink and color print cartridges. However, as will be seen, in the present utilization of printer 10, the pair of print cartridges 26 are being used to apply differing types of ink. The inks may also be of differing colors, but color printing is not the reason for the differing kinds of ink in the cartridges, as will be seen. Stated again, these differing types of ink in the pair of print cartridges 26 may both be of the same color, or they may be of differing colors.

More particularly, the inkjet print cartridge(s) 26 each include a cartridge body 28, which internally defines an ink reservoir (generally referenced with the arrowed numeral 28*a*), and a fluid delivery assembly (generally referenced with the arrowed numeral 30) supplying printing fluid (such as ink of particular types, recalling the explanation above) to a respective print head 32. The print head 32 is carried by the printing cartridge body 28. The fluid delivery assembly 30 may include a sponge carried within a chamber of the body 28 and a standpipe (the sponge, chamber, and standpipe not being individually illustrated in the drawing Figures), conveying the printing fluid from the chamber to the print head 32. As those ordinarily skilled in the relevant printing arts will understand and know, the print heads 32 include a printing circuit which electrically couples the print head 32 via circuit traces and electrical contacts with driving electronics of the printer 10. That is, the print heads 32 have plural fine-dimension orifices (indicated by the arrowed numeral 34) directed toward the print media 18. From individually addressable ones of these print orifices fine-dimension jets of printing fluid are directed onto the print media in order to form characters and images.

Turning now to FIG. 3, it is seen that the print media 18 includes a substrate 36, which may be paper, although the invention is not so limited. The media 18 carries atop of the substrate 36 a coating 38 of dye-ink-penetrable material. That is, the coating 38 allows dye type ink to penetrate into and through the coating so that this dye type ink can reside in either one or both of the coating 38 and substrate 36. As is also illustrated in FIG. 3, and also by FIGS. 5*a* and 5*b,* the print media 18 may be printed in order to carry a secure message 40. That is, viewing FIG. 5*a,* dye type ink 42 may be applied using a printer 10 in order to form a message 40. It is noted that the message 40 is actually within the media 18 because the dye type ink sinks into the layer 38 of dye penetrable coating material. That is, as is seen in FIG. 3, the dye type ink penetrates into and through the layer 38 of material, and forms an image or character (i.e., as is seen in FIG. 5*a*) for the secure message 40.

Further, and as is seen in FIGS. 3 and 5*b,* in order to obscure the secure message 40, a layer 44 of pigment type ink is applied in an area 44*a* which overlies and obscures the message 40. But, the pigment type ink 44 does not adhere tenaciously to the coating layer 38. Consequently, as is illustrated in FIG. 5*c,* all or a portion of the pigment type ink 44 may be removed using mild abrasion (as is indicated by the dithered arrow 46) in order to reveal the secure message 40. As is apparent from FIG. 5*c,* in the event that an unauthorized individual removes the over coat layer 44 of pigment type ink, then the fact that the security of the document has been compromised is apparent and cannot be effectively concealed.

Figure 6A:
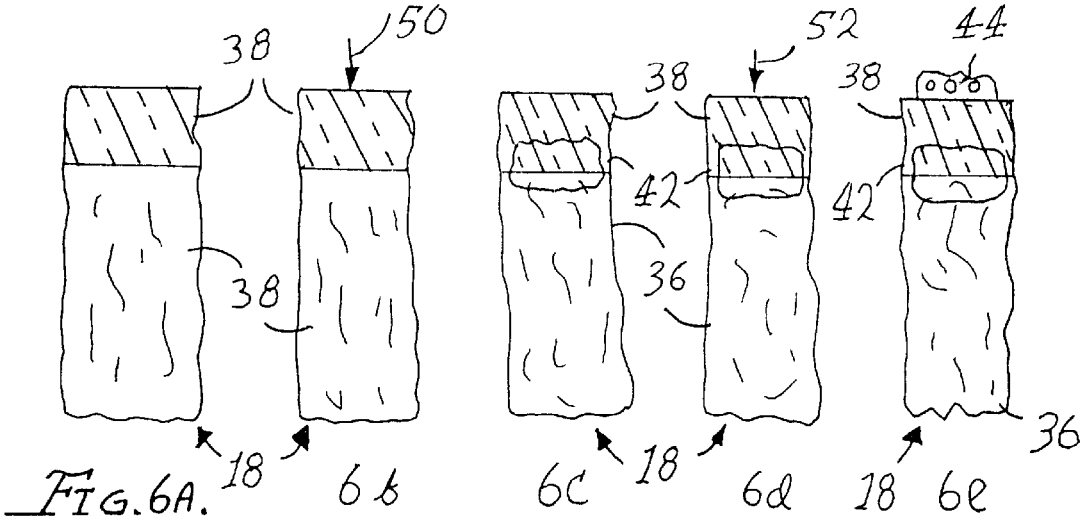

Returning now to a consideration of FIG. 2, and considering now FIGS. 6*a* through 6*e* also, a method of printing the security document seen in FIGS. 3 and 5 is disclosed. FIG. 6*a* shows the print media 18 before the application of any ink. The media 18 includes substrate 36, and dye-ink penetrable layer 38. Although FIG. 6 indicate that the substrate 36 is fibrous (i.e., paper) this need not be the case. The substrate 36 could be a non-fibrous, non-porous material, as will be seen from an alternative embodiment of the invention disclosed below.

FIGS. 2 and 6*b* show that during a typical scan or traverse of the print cartridges 26*a* and 26*b* across the print media 18 (as is indicated by arrowed numeral 48) the first or leading one (i.e., in the direction of scan 48) of the cartridges 26*a* is used to discharge (arrow 50 in FIGS. 2 and 6*b*) a dye type ink controllably from the print orifices 34 of this print cartridge. As will be understood in view of the existing technology for thermal ink jet printing and the explanation above, this printing on print media 18 using the dye penetrant type of ink forms the characters 42, and message 40. As FIGS. 6*b* and 6*c* show by comparison, the dye penetrant ink 42 is applied onto the surface of the coating 38 and penetrates into and through this coating. The coating 38 is thus seen to be porous, penetrable, or permeable to the dye type ink 42. Penetration of the ink 42 into and through the coating 38 may be very rapid (i.e., almost instantaneous) or may require a time interval (i.e., although this time interval will be comparatively short). Thus, FIG. 6*c* indicates a penetration step for the dye penetrant ink into and through the coating 38.

At the moment of application of the characters 42 forming message 40, this message is exposed. Thus, it is desirable to obscure this message as soon as is possible in order that the security of a document is not compromised by individuals that may not be entitled to see its contents, but who may have access to the printer 10 during the printing operation itself. Thus, and most desirably, during this same printing scan (i.e., the scan indicated by arrow 48), the layer 44 of obscurant opaque pigment ink is applied using the second print cartridge 26*b.* In this case, the time interval between application of the ink 42 to the print media 18, and the application of the ink 44, will be very short. The time interval will correspond to the spacing between the cartridges 26*a* and 26*b,* in view of the speed of traverse of the carriage 24*a* across the media 18.

However, as was pointed out above, it may be appreciated that the dye penetrant type of ink 42 must penetrate into and partially through the layer 38 in order to reach substrate 36. In such cases, it is alternatively contemplated that the carriage 24 may be scanned in a first direction during which the dye penetrant ink is applied to the print media from cartridge 26*a,* but during which no opaque obscurant pigment ink is applied from cartridge 26*b* over the characters and images laid down from cartridge 26*a.* Then, during a return scan in the direction opposite to that indicated by arrow 48, or in a still later subsequent scan in the same direction indicated by arrow 48 (i.e., requiring that the carriage 26 first scan in the opposite direction in preparation to the second scan in direction 48) the cartridge 26*b* is used to apply the overcoat layer of obscurant pigment ink 44. Thus, a time interval may be provided between the application of the dye penetrant ink 42, and the application of the obscurant pigment ink 44, during which time interval the dye penetrant ink is allowed to penetrate into and partially through the coating layer 38, and into the substrate 36. As alluded to above, FIG. 6*c* indicates a method step of providing a time interval (of indeterminate duration) between the application of ink 42 and the application of ink 44. FIG. 6*c* also indicates the method step of penetrating the dye type ink into and through the coating layer 38, and into the substrate 36.

FIGS. 2 and 6*d* indicate with arrow 52 the application of the opaque obscurant pigment type ink 44 from cartridge 26*b* onto the surface of the coating 38. Ink 44 does not substantially penetrate into the coating 38. Because the ink 44 is opaque, it obscures the message 40 formed by ink 42. As was explained above, the ink 44 is removable by use of abrasion, for example, to reveal the message 40.

Figure 7A:
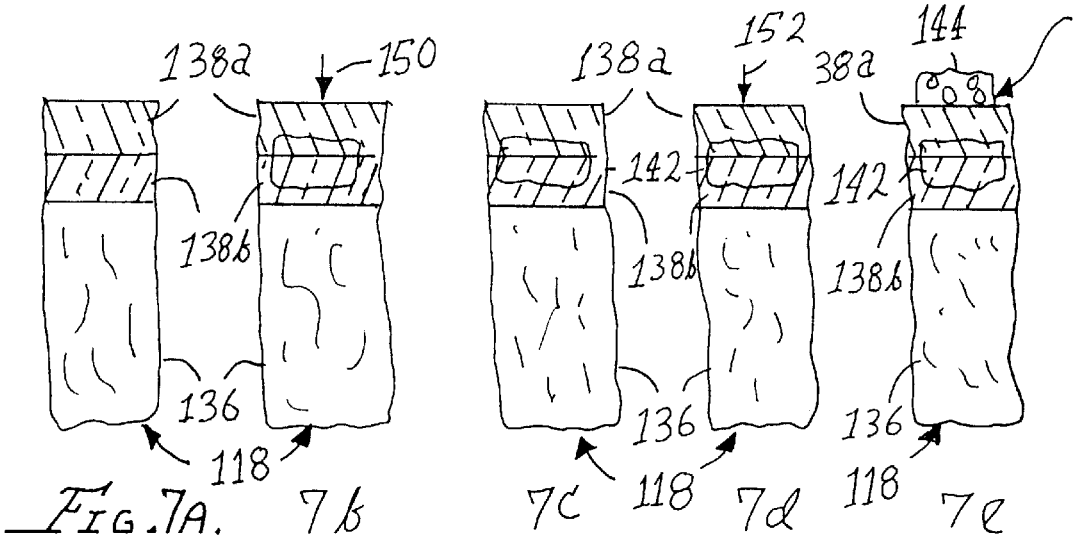

FIGS. 4, 7*a* through 7*c,* and FIG. 8 depict alternative embodiments of the present invention. Because this second embodiment of the invention and the first embodiment described above share many features, features of the second embodiment which are the same, or which are analogous in structure or function, are indicated in FIGS. 4, 7*a*–7*e,* and on FIG. 8 with the same numeral used above, but increased by one-hundred (100). FIGS. 4, and 7*a* illustrate a print media 118 including a substrate 136, which may be a plastic film, although the invention is again not so limited. Importantly, the substrate 136 of print media 118 preferably is a plastic film. This plastic film 136 offers distinct advantages over paper in that it is not easily torn, is durable and water proof, and can be either opaque (which is the usual case) or may be transparent. In the event that the portion of the substrate 136 of media 118 seen in FIG. 4 is transparent, then it may be carried upon or may be removably bonded to, for example, an opaque layer of plastic or paper (not shown in the drawing Figures). Unique advantages for the security document 118 arise from its being so bonded to an opaque carrier, as are explained below.

The media 118 carries atop of the substrate 136 a coating 138, which is in actuality a duality of coatings 138*a* and 138*b*. Similarly to the first embodiment described above, the coating 138*a* is of dye-ink-penetrable material. That is, the coating 138 allows dye type ink to penetrate into and through the coating so that this dye type ink can reside in either one or both of the coating 138*a* and coating 138*b*. However, as will be seen, coating 138*b* is of recipient/barrier nature with respect to the dye type of ink, so that the ink does not penetrate into substrate 136. In fact, because the substrate 136 is preferably plastic film, the dye penetrant ink would not penetrate into the substrate 136.

Turning now to a consideration of FIG. 8, and considering FIGS. 7*a* through 7*e* also in conjunction with FIG. 4, a method of printing a security document on this second type of print media 118 is disclosed. FIG. 7*a* shows the print media 118 before the application of any ink. As is illustrated in FIG. 4, and also by FIG. 7*b*, the print media 118 may be printed using a dye type of ink in order to carry a message, which may be made secure by an overlying opaque coating, as will be described, and recalling the description of the first embodiment described above. That is, viewing FIGS. 4 and 7*b*, dye type ink 142 may be applied using a printer in order to form characters and images of a message. As is seen in FIG. 4, the dye type ink penetrates into and through the layer 138*a* of coating material, penetrates into the recipient/barrier layer 138*b*, and forms an image or characters (i.e., as was seen in FIG. 5*a*). Further, and as is seen in FIGS. 4 and 7*d*, in order to obscure the message, a layer 144 of pigment type ink is applied in an area which overlies and obscures the message resident in the layer 138*b*, but the pigment type ink does not adhere tenaciously to the coating layer 138*a*.

FIGS. 8 and 7*b* show that in a printing method to produce a security document on the print media 118 (i.e., actually in the media 118) during a typical scan or traverse of at least two print cartridges 126*a* and 126*b* across the print media 118 (as is indicated by arrowed numeral 148) the first or leading one (i.e., in the direction of scan 148) of the cartridges 126*a* and 126*b* (i.e., cartridge 126*a* in this case) is used to discharge (arrow 150 in FIGS. 8 and 7*b*) a dye type ink controllably from the print orifices 134 of this print cartridge 126*a*.

As FIGS. 7*b* and 7*c* show by comparison, the dye penetrant ink 142 is applied onto the surface of the coating 138*a* and penetrates into and through this coating to be received by the recipient/barrier coating 138*b*. The coating 138*b* receives the dye type ink, and this is where the message formed by this ink is resident in the media 118.

Again, it is to be understood that penetration of the dye type ink 142 into and through the coating 138*a* may be very rapid (i.e., almost instantaneous) or may require a time interval (i.e., although this time interval will be comparatively short). Thus, FIG. 7*c* indicates a penetration step (and time interval) for the dye penetrant ink 142 to penetrate into and through the coating 138*a*, and to and into the recipient/barrier coating 138*b*.

Again, the layer 144 of obscurant opaque pigment ink is applied using the second print cartridge 126*b*. In this case, the time interval between application of the ink 142 to the print media 118, and the application of the ink 144, will be very short. The time interval will correspond to the spacing between the cartridges 126*a* and 126*b*, in view of the speed of traverse of the carriage 124*a* across the media 118. Again, as was pointed out above, it is contemplated that the carriage 124 may be scanned in a first direction during which the dye penetrant ink 142 is applied to the print media from cartridge 126*a*, but during which no opaque obscurant pigment ink 144 is applied from cartridge 126*b* over the characters and images laid down from cartridge 126*a*. Then, during, a later scan of the print cartridges 126*a* and 126*b*, the cartridge 126*b* is used to apply the overcoat layer of obscurant pigment ink 144.

Thus, a time interval may be provided between the application of the dye penetrant ink 142, and the application of the obscurant pigment ink 144, during which time interval the dye penetrant ink is allowed to penetrate into and through the coating layer 138*a*, and into the recipient/barrier layer 138*b*.

As alluded to above, FIG. 7*c* indicates a method step of providing a time interval (of indeterminate duration) between the application of ink 142 and the application of ink 144. FIG. 7*c* also indicates the method step of penetrating the dye type ink into and through the coating layer 138*a*, and into the coating layer 138*b*.

However, it is noted in FIG. 8 that the printer 110 includes a trio of the print cartridges 126. That is, the printer 110 has print cartridge 126*a* of dye penetrant type ink, and has cartridge 126*b* of opaque pigment ink. But, the carriage 124*a* for printer 110 also has another cartridge 126*c* on the opposite side of cartridge 126*a* from the cartridge 126*b* of opaque pigment ink. This third cartridge 126*c* is like cartridge 126*b* and includes opaque pigment ink. Thus, in those cases in which the time interval required for penetration of the dye penetrant ink from cartridge 126*a* into the coating layer 136*a*, so that the opaque pigment ink layer can be put on by the next following cartridge (i.e., either cartridge 126*b* or cartridge 126*c*) during the same scan of the carriage 124*a*, it follows that printer 110 can carry out bi-directional printing of security documents. Again, it is to be noted that the opaque obscurant pigment type ink 144 from cartridges 126*b* and 126*c* adheres onto the top surface of the coating 138*a*. Ink 144 does not substantially penetrate into the coating 138*a*. Because the ink 144 is opaque, it obscures the message 140 formed by ink 142. But, the ink 144 is removable with relatively light abrasion in order to expose the message formed by ink 142. Further, in the case in which the substrate 136 is transparent, and this substrate is to be carried on an opaque paper card or plastic sheet, for example, then the quality of the finished printed security document can be verified by reading the "mirror image" of the secure message that may be viewed through the back side of the substrate 136. After the quality of the message image and characters is confirmed during making of the security document, then the substrate 136 is attached to its carrier.

Now, viewing FIGS. 9*a* and 9*b*, yet another advantage of the present invention is depicted. As was noted above, conventional security documents are apparent in their nature as security documents. That is, a lottery ticket with a "scratch off" area is easily recognized. Similarly, the scratch off areas of other types of conventional security documents is easily recognized. Thus, the mere fact that a document can be easily recognized as a security document itself compromises the security of the document. Easy recognition of security documents makes their interception easier, which is undesirable. Now, in contrast to the conventional technology, the present inventive security documents have their opaque obscurant layer made of pigment ink that is very little different than other printing inks at first inspection. That is, the security documents according to the present invention may be covert in nature, and steps may be taken to further conceal the fact that documents according to the present invention are in fact security documents having secure information imbedded in them. Stated differently, security documents according to the present invention may, if desired, be configured so as to appear to be another type of document, and so as to not have a "scratch off" area. In such cases, the intended recipient alone (among other possible unintended recipients) will know that the document is a security document, and the area where the secure message is concealed.

Also, because the opaque obscurant ink of a security document according to this invention may be applied by an inkjet printing cartridge (i.e., the cartridges 26*b,* 126*b,* and 126*c*), these print cartridges can be used to themselves print a message. The obscurant message may have significance as a communication, or may simply be innocuous words and phases, for example, a passage of Shakespeare may be used to conceal a secure message underneath. Alternatively, a security document according to this invention may appear to be, for example, a common advertising flyer. Such flyers commonly have product logos, and large type face type under which a secure message can be concealed.

FIG. 9*a* gives one example of a security document 54 having a secure message 56 (i.e., the word "secret") which it is desired to convey to a recipient without having the fact made apparent that the conveying document 54 is a security document. As is seen in FIG. 9*a,* the secure message 56 includes several letters, or characters 58. FIG. 9*b* illustrates that one way in which this objective of having the document 54 appear to be something other than a security document may be achieves is to conceal the secure message 56 under the text of an otherwise innocuous message 60. In this case, the innocuous concealing message 60 is the word "secure." However, a variety of concealing messages, images, logos, and devices may be utilized. Importantly, the document 54 having the visible message "secure" does not itself reveal its nature as a security document. The document 54 may appear to be simply a page off an inkjet printer which only the intended recipient will know carries the "secret" message 56.

Thus, the security of security documents produced using the present inkjet printing methodology is improved because they can be made to look like something other than security documents. That is, according to the present invention, the removable layer of pigment ink may itself be used to print out an apparent message, which apparent message tends to make the document appear innocuous, and which in fact conceals the underlying secure message. The intended recipient alone will know the true nature of the document, and the area of the apparent message to be abraded off to reveal the secure message.

Those skilled in the art will further appreciate that the present invention may be embodied in other specific forms without departing from the spirit or central attributes thereof. Because the foregoing description of the present invention discloses only particularly a preferred exemplary embodiment of the invention, it is to be understood that other variations are recognized as being within the scope of the present invention. Accordingly, the present invention is not limited to the particular embodiment which has been described in detail herein. Rather, reference should be made to the appended claims to define the spirit and scope of the present invention.

What is claimed is:

1. A printing system for making a security document, comprising:

a first print cartridge having a type of penetrant ink to be applied to a sheet-like media during a first time period to create a message, the sheet-like media formed from a substrate material having an exterior permeable or porous coating layer capable of allowing said penetrant ink to enter into and through the coating layer to reach said substrate material;

a second print cartridge having a type of opaque ink to be applied to the sheet-like media during a second subsequent time period to create an overcoating on the media, said overcoating obscuring said message without substantially penetrating the coating layer;

a carriage for holding said first and second print cartridges; and a traverse mechanism for moving said carriage across the media while said first and second print cartridges apply said penetrant ink and said opaque ink during said first and second time periods, respectively, and wherein said first time period is of sufficient duration to allow said penetrant ink to sink through the coating layer and reach the substrate material.

2. The printing system of claim 1 wherein said traverse mechanism moves said carriage in a scanning direction across the media, and said penetrant ink and said opaque ink are applied to media during a same scan of said carriage in said scanning direction.

3. The printing system of claim 1 wherein said traverse mechanism moves said carriage in a scanning direction across the media, and said penetrant ink and said opaque ink are applied to media in different scans, respectively, of said carriage in said scanning direction.

4. The printing system claim 3 wherein said traverse mechanism moves said carriage in a scanning direction across the media, and said different scans include a forward scan and a return scan.

5. The printing system of claim 3 wherein said traverse mechanism moves said carriage in a scanning direction across the media, and said different scans include a first scan and a later scan, respectively, in a same direction or in opposite directions.

6. The printing system of claim 1 wherein said penetrant ink comprises a dye based ink.

7. The printing system of claim 1 wherein said opaque ink comprises a pigment based ink.

8. A method of printing a security document, comprising:

providing sheet-like media with a substrate, and with a front surface portion which is sufficiently porous or permeable to allow certain marking fluids to sink into and penetrate through the front surface portion;

providing a printer having a first printhead with a first type of penetrant marking fluid capable of sinking into and penetrating through the front surface portion, and a second printhead with a second different type of marking fluid which will not substantially penetrate into the front surface portion of the sheet-like media;

passing the first printhead over the media to create a message securely imbedded into the front surface by applying the first type of marking period on the front surface of the media during a first time fluid, allowing sufficient time for the penetrant marking fluid to penetrate into the front surface portion and reach the substrate;

subsequently passing the second printhead over the media to obscure the message by applying the second different type of marking fluid over the message to hide and obscure the message by overlying the front surface portion of the sheet-like media.

9. The method of claim 8 which includes providing a dye based ink in the first printhead.

10. The method of claim 8 which includes providing a pigment based ink in the second printhead.

11. The method of claim 8 which includes non-layered media comprising a material having the aforesaid front surface.

12. The method of claim 8 which includes providing a removable type of opaque ink in the second printhead which upon removal can reveal the previously obscured message, and applying a sufficient amount of the opaque type of ink in order to show a visible display taken from the following group: text, characters, images, logos.

13. The method of claim 8 which includes layered media wherein the front surface portion constitutes a separate external layer.

* * * * *